US006062174A

United States Patent [19]

Abe

[11] Patent Number: 6,062,174

[45] Date of Patent: May 16, 2000

[54] REDUCED-PRESSURE STEAM HEATING DEVICE AND METHOD FOR PREVENTING BANGING NOISE GENERATED THEREIN

[75] Inventor: Toshio Abe, Sapporo, Japan

[73] Assignee: Kabushiki Kaisha Kopuran, Sapporo, Japan

[21] Appl. No.: 08/548,316

[22] Filed: Nov. 1, 1995

[30] Foreign Application Priority Data

Nov. 2, 1994 [JP] Japan ..... 6-293897

[51] Int. Cl.[7] ..... F22B 1/00

[52] U.S. Cl. ..... 122/4 R; 392/403; 366/147

[58] Field of Search ..... 122/13.1, 13.2, 122/14, 15, 16, 17, 33, 37, 4 R; 237/59, 63, 70, 74; 126/113; 392/394, 399, 400, 401, 402, 403, 441, 449, 451; 366/144, 145, 146, 147

[56] References Cited

U.S. PATENT DOCUMENTS

| | | | |
|---|---|---|---|
| Re. 33,414 | 10/1990 | Morton | 392/386 |
| 1,987,182 | 1/1935 | Dalen et al. | 122/33 |
| 2,478,569 | 8/1949 | Cooper | 122/37 |
| 3,437,078 | 4/1969 | Olson | 122/37 |
| 3,674,204 | 7/1972 | Brandl | 237/8 |
| 3,704,691 | 12/1972 | Brandl | 122/33 |
| 3,746,079 | 7/1973 | Arenson | 122/33 |
| 3,773,019 | 11/1973 | Hapgood | 122/33 |
| 3,793,993 | 2/1974 | Teagan | 122/33 |
| 3,815,552 | 6/1974 | Koula | 122/37 |
| 3,891,817 | 6/1975 | Brown | 219/688 |
| 3,968,835 | 7/1976 | Hartmann et al. | 122/37 |
| 4,056,582 | 11/1977 | Chow | 126/113 |
| 4,139,762 | 2/1979 | Pohrer et al. | 126/113 |
| 4,221,955 | 9/1980 | Joslyn | 392/328 |
| 4,230,536 | 10/1980 | Sech | 203/89 |
| 4,238,337 | 12/1980 | Peters et al. | 210/629 |
| 4,239,956 | 12/1980 | Morton | 219/272 |
| 4,474,139 | 10/1984 | Dobias | 122/13.1 |
| 4,503,810 | 3/1985 | Fujishita et al. | 122/13.1 |
| 4,761,204 | 8/1988 | Kohl et al. | 432/4 |
| 4,771,762 | 9/1988 | Bridegum | 122/17 |
| 4,790,289 | 12/1988 | Barrett | 126/362 |
| 4,823,770 | 4/1989 | Loeffler | 122/17 |
| 4,836,891 | 6/1989 | Files et al. | 122/33 |
| 4,921,166 | 5/1990 | Matsumoto et al. | 237/59 |
| 4,938,204 | 7/1990 | Adams | 122/33 |
| 5,059,287 | 10/1991 | Harkey, Sr. | 122/13.1 |
| 5,069,169 | 12/1991 | Maruko | 122/33 |

FOREIGN PATENT DOCUMENTS

2678361A1 12/1992 France .

OTHER PUBLICATIONS

Japanese Patent Publication #06277261A, Oct. 1994.

*Primary Examiner*—Denise L. Ferensic
*Assistant Examiner*—Jiping Lu
*Attorney, Agent, or Firm*—Arent, Fox, Kintner, Plotkin & Kahn, PLLC

[57] ABSTRACT

A reduced-pressure steam heating device and a method for eliminating the banging noise generated therein as the heat carrier fluid is being heated. In the device, a heat carrier fluid sealed inside an evacuated container is heated to generate steam, the heat of which is used to heat the intended object. The heat carrier fluid is agitated and circulated as it is being heated to eliminate any banging noise.

5 Claims, 3 Drawing Sheets

REDUCED-PRESSURE STEAM HEATING DEVICE AND METHOD FOR PREVENTING BANGING NOISE GENERATED THEREIN

FIELD OF THE INVENTION

This invention relates to a reduced-pressure steam heating device used in a variety of heating equipment. The invention may also be used for road heating, snow melting, or similar purposes.

BACKGROUND OF THE INVENTION

In a conventional reduced-pressure steam heating device, a heat carrier fluid is enclosed inside a sealed evacuated container. The container is heated to generate high-temperature steam. The heat of the steam produced is used to heat the targeted object.

The above described conventional device is susceptible to the creation of a banging noise as the heat carrier fluid is being heated, specifically when the evacuated container is in a low pressure state. Moreover, the vibrations that accompany this noise can have a harmful effect on the surroundings.

SUMMARY AND OBJECTIVES OF THE INVENTION

To resolve these problems, the present invention provides a reduced-pressure steam heating device, and a method to prevent the banging noise generated with heating of the heat carrier fluid.

A novel method is applied to a reduced-pressure steam heating device in which a heat carrier fluid sealed inside an evacuated container is heated and the steam so generated heats the object body. Specifically a method to eliminate the banging noise generated as the heat carrier fluid is heated is provided wherein the heat carrier fluid is circulated during heating to eliminate any noise generation therein.

Further, a novel reduced-pressure steam heating device is provided that comprises a sealed evacuated container, a heating means to heat a heat carrier fluid sealed inside the container to generate steam, a heat exchange means to transfer the heat of the generated steam to the object to be heated, and an agitation means to agitate and circulate the heat carrier fluid sealed within the container.

A novel reduced-pressure steam heating device may also be provided that comprises a sealed evacuated radiating housing to transfer heat to a body to be heated, a heating means to heat a heat carrier fluid sealed inside the housing to generated steam, and an agitation means to agitate and circulate the heat carrier fluid sealed within the housing.

As explained herein, the agitation device of this invention circulates the heat carrier fluid, and this flow reduces or eliminates the banging noise generated upon heating the heat carrier fluid.

SIMPLIFIED EXPLANATION OF THE DRAWINGS

The above and other objects and the attendant advantages of the present invention will become readily apparent by reference to the following detailed description when considered in conjunction with the accompanying drawings wherein.

DETAILED DESCRIPTION OF THE INVENTION AND OF THE PREFERRED EMBODIMENT

1. Radiating Housing

The radiating housing 1 is a sealed container in which the internal pressure is reduced to a pressure of less that one atmosphere. Heat is generated at the radiating housing's 1 surface and transmitted to the object to be heated. The radiating housing 1 is made of a metal that is a good heat conductor, and has properties consistent with the objective of heating.

The radiating housing 1 can be fabricated in any arbitrary shape to fit the environment in which it will be used, intended to be used, or environmental factors dictated by other condition. The radiating housing 1 should be of sufficient volume to leave adequate space once the heat carrier liquid 6 in enclosed. The temperature of the heat emitted from the radiating housing 1 is a function of the ratio of the surface area of the heating unit 21 to that of the radiating housing 1. Therefore, the dimensions of both components should be designed to provide relative surface areas that will yield the desired heating temperature.

The radiating housing 1 has two functions; first, as a container for the heat carrier fluid 6, and second, as a heat exchange means to transfer heat to the body to be heated. The two functions, however, can be set in separate units.

2. Heating Device

Figure 1:
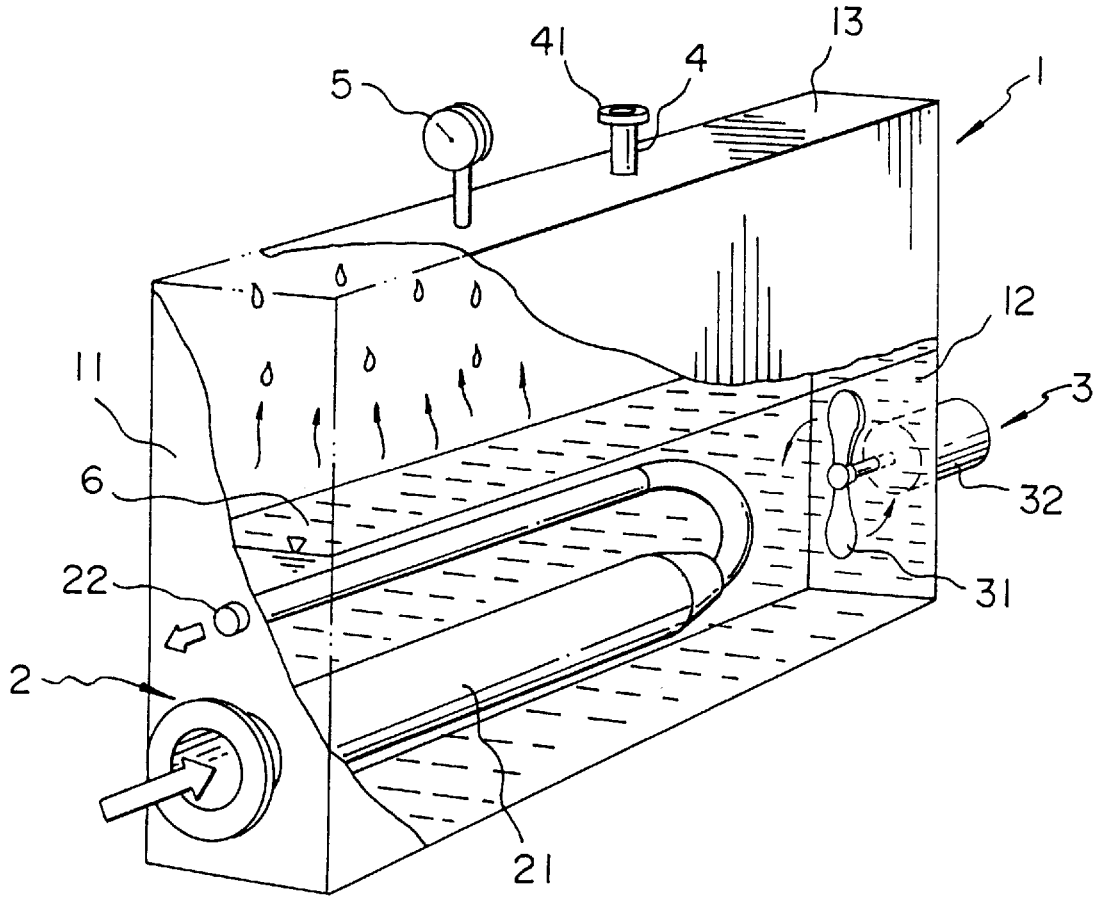
FIG. 1 is an explanatory diagram of the embodied in Example 1.

The heating device 2 is a hollow body used to heat the heat carrier fluid 6 enclosed inside the radiating housing 1. For example, as shown in FIG. 1, one, or more, cylindrical heating units 21, may be used as deemed appropriate and are arranged horizontally in the lower portion of the radiating housing 1. One end of the heating unit(s) penetrates through an opening on the side face 11 of the radiating housing 1 to enable passage to a burner or similar heater, not shown in the diagram.

The other end of each heating unit 21 has passage to an exhaust pipe 22, the end of which also penetrates through an opening on the side face 11 of the radiating housing 1. Combustion gas generated by the burner is fed into the heating unit 21, heats the heat carrier fluid 6, and then exhausted via the exhaust pipe 22 outside of the radiating housing 1.

In installing the heating unit 21 into the radiating housing 1, it should be sealed tightly to the opening in order to maintain the hermetic seal with the radiating housing 1. The heating device 2 is U-shaped as shown in FIG. 1, but it can be configured in a "M" or a variety of other shapes. As well, the openings for the heating unit 21 and exhaust pipe 22 can be set on side face 11 and side face 12 respectively of radiating housing 1, such that the heating device will penetrate through the radiating housing 1 in a straight line.

3. Agitation Device

The agitation device 3 is attached on side face 12, but may attached to other faces of the radiating housing 1. The agitation device 3 is comprised of stirrer blades 31 located inside the radiating housing 1, and a motor 32 to rotate the blades, mounted on the exterior of the housing. The motor 32 rotates the blades 31 to circulate the heat carrier fluid 6. This flow of the fluid will reduce or eliminate the banging noise generated during heating.

Agitation is not restricted to the stirrer blades 31, and a variety of configurations can be used, provided the heat carrier fluid 6 is adequately circulated. Also, the entire agitation device 3, including the motor 32, can be set inside the radiating housing 1.

5. Heat Carrier Fluid

The heat carrier fluid 6 is a condensable fluid sealed inside the radiating housing 1. Water, alcohol, ammonia, potassium, or any mixture or compound thereof that is a condensable fluid can be used.

The heat carrier fluid 6 should be added only in an amount sufficient to immerse all of the heating device 2. If the unit will be in an environment where the heat carrier fluid 6 can freeze, the volume must be set so that the radiating housing 1 will not crack as the heat carrier fluid 6 expands upon freezing.

6. Operation

Thirty liters of heat carrier fluid 6 are poured through the socket 4 in top wall 13 into the radiating housing 1. The burner is lit and the combustion gas generated therein is fed into the heating device 21, and the exhaust gas is exhausted through pipe 22 and outside of the radiating housing 1.

The heat carrier fluid 6 is boiled for 10 minutes, during which air inside the radiating housing 1 is expelled by the steam so generated through the socket 4. The plug 41 is then inserted to block air from entering the radiating housing, which is then cooled to reduce the internal pressure.

At this point, the vacuum gage 5 reads −730 mm Hg, and the temperature of the external wall surface of the radiating housing 1 is 30° C. The object body can thus be heated by the heat being radiated from the external wall surface.

However, if the combustion gas was fed into the heating unit 21 with the agitation device 3 turned off, a banging noise was generated inside the radiating housing 1 until the vacuum gage rose to −500 mm Hg; that is, during a low pressure state. Accordingly, the flow of combustion gas was stopped temporarily until the temperature of the external wall surface fell to 30° C., then the agitation device 3 was turned on, after which supply of the combustion gas was restarted. In this case, no banging noise was generated. That is, circulation of the heat carrier fluid 6 during heating will clearly prevent any banging noise.

7. Experimental Results

Figure 2:
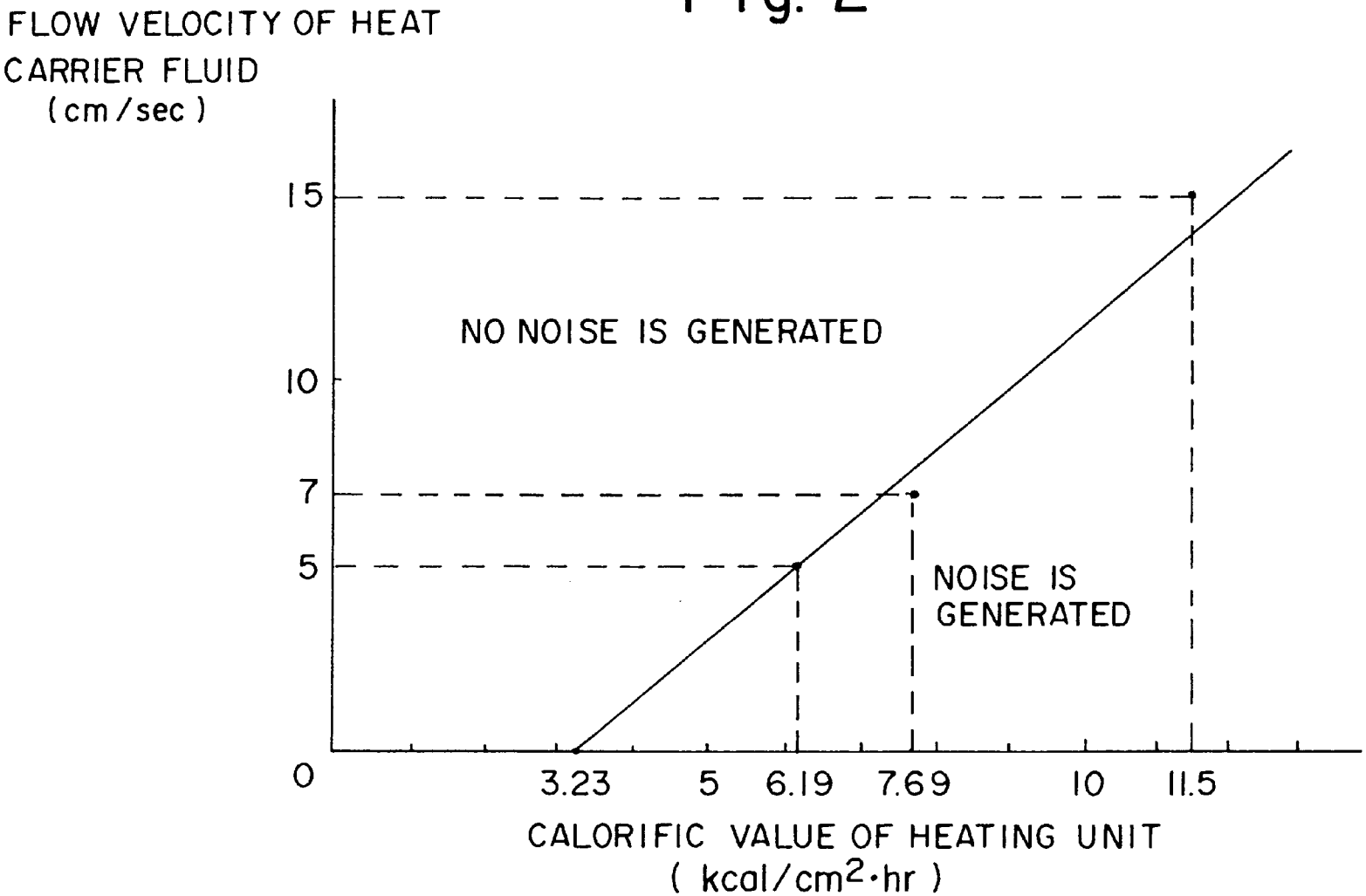
FIG. 2 is a graph of experimental results.

FIG. 2 is a graph of results obtained experimentally to determine the flow velocity of the heat carrier fluid 6 required in order to eliminate noise generation. No noise was generated at a ratio of the flow velocity of the heat carrier fluid to the calorific value of the heating unit 5/6.19, 7/7.69 and 15/11.5 (units omitted). That is, since the noise volume is proportional to the calorific value of the heating unit, then clearly a proportional relationship exists as well between the noise volume generated and the flow velocity of the heat carrier fluid required to eliminate the noise. The equation of the line shown in FIG. 2 is $v=(1.69\ cm^3\ hr/kcal\text{-}sec)C-5.45$ cm/sec, where C is the calorific value of heat carried by the carrier fluid in units of $kcal/cm^2$ hr.

8. Alternate embodiment

Figure 3:
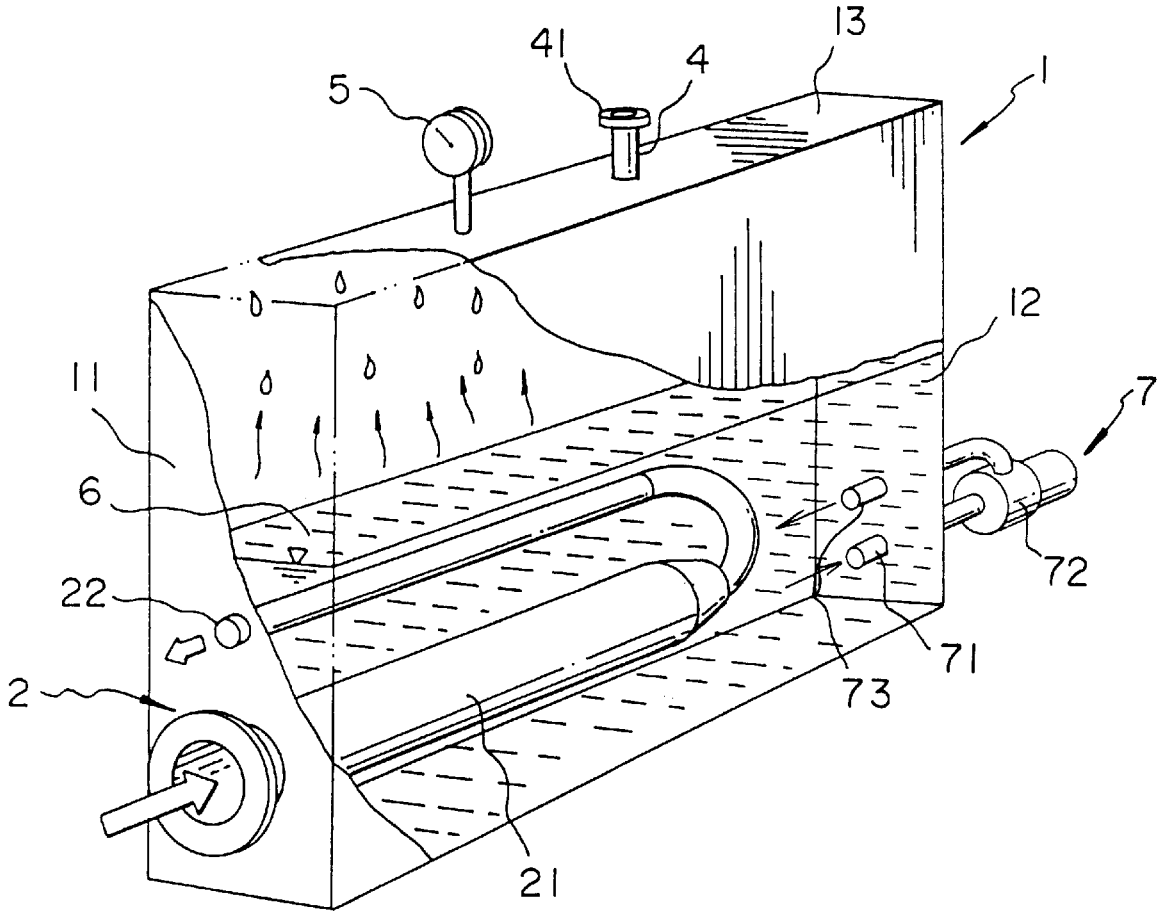
FIG. 3 is an explanatory diagram of this invention as embodied in Example 2.

FIG. 3 illustrates another example of the agitation device for the heat carrier fluid. The agitation device 7 is comprised of a suction pipe 71 penetrating through, and affixed on, the side wall 12 of the radiating housing 1. A suction pump 72 is installed on the external end of the suction pipe 71, and a drain pipe 73, to form a passage from the pump 72 into the radiating housing 1. Alternatively, the entire agitation device 7, including the pump 72, can be installed inside the radiating housing 1.

The agitation device 7 is a circulation system in which operation of the pump 72 causes heat carrier fluid 6 to be sucked out of the radiating housing 1 through the suction pipe 71, then recycled back into the radiating housing 1 through the drain pipe 73. Flow of the heat carrier fluid 6 by this circulation reduces any banging noise upon generation of the steam.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A method to eliminate banging noises generated as a heat carrier fluid is heated in a heating device comprising the steps of:

heating a heat carrier fluid sealed in an evacuated container;

while heating, circulating the heat carrier fluid at a flow velocity sufficient to eliminate said banging noises, wherein said velocity is greater than or equal to a quantity v defined approximately by $$V=(1.69cm^3hr/kcal\text{-}sec)C-5.45cm/sec$$

where C is a calorific value of heat carried by said carrier fluid in units of $kcal/(cm^2\ hr)$.

2. The method of claim 1, wherein the heat carrier fluid is a liquid, said heating step includes vaporizing part of the heat carrier fluid sealed in an evacuated metal heat conducting container;

said circulating step includes operating an electrically driven device to move the heat carrier fluid at a velocity sufficient to eliminate banging noises during circulation; and the method further comprises transferring heat through the metal heat conducting container from the heat carrier fluid to a mass outside the container.

3. The method of claim 1, wherein:

the heat carrier fluid is a liquid, said heating step includes vaporizing part of the heat carrier fluid sealed in an evacuated metal heat conducting container;

said circulating step includes moving mechanical parts of a device to move the carrier fluid at a velocity sufficient to eliminate banging noises during circulation; and the method further comprises transferring heat through the metal heat conducting container from the heat carrier fluid to a mass outside the container.

4. The method of claim 1 wherein:

the heat carrier fluid is a liquid, said heating step includes vaporizing part of the heat carrier fluid sealed in an evacuated metal heat conducting container;

said circulating step includes interrupting a flow of the heat carrier fluid resulting from the heating to move the heat carrier fluid at a velocity sufficient to eliminate banging noises during circulation; and the method further comprises transferring heat through the metal heat conducting container from the heat carrier fluid to a mass outside the container.

5. The method of claim 1, wherein the heat carrier fluid is a liquid, said heating step includes vaporizing part of the heat carrier fluid sealed in an evacuated metal heat conducting container;

said circulating step includes, in addition to any movement of the heat carrier fluid generated due to heating, generating additional movement of the heat carrier fluid to move the heat carrier fluid at a velocity sufficient to eliminate banging noises during circulation; and the method further comprises transferring heat through the metal heat conducting container from the heat carrier fluid to a mass outside the container.

* * * * *